US009159178B2

(12) United States Patent
Yasue

(10) Patent No.: US 9,159,178 B2
(45) Date of Patent: Oct. 13, 2015

(54) IN-VEHICLE CONTROL SYSTEM AND IN-VEHICLE CONTROL APPARATUS

(71) Applicant: DENSO CORPORATION, Kariya, Aichi-pref. (JP)

(72) Inventor: Motohiro Yasue, Tokai (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/277,180

(22) Filed: May 14, 2014

(65) Prior Publication Data

US 2014/0358360 A1 Dec. 4, 2014

(30) Foreign Application Priority Data

May 29, 2013 (JP) ..... 2013-113188

(51) Int. Cl.
*G07C 5/08* (2006.01)

(52) U.S. Cl.
CPC ..... *G07C 5/085* (2013.01)

(58) Field of Classification Search
None
See application file for complete search history.

(56) References Cited

U.S. PATENT DOCUMENTS

| | | | | |
|---|---|---|---|---|
| 2002/0040261 | A1* | 4/2002 | Nakamoto et al. | 701/1 |
| 2005/0216135 | A1* | 9/2005 | Sayama et al. | 701/1 |
| 2006/0200276 | A1* | 9/2006 | Sayama et al. | 701/1 |
| 2007/0198874 | A1* | 8/2007 | Watanabe | 714/49 |
| 2008/0238192 | A1* | 10/2008 | Hashimoto et al. | 307/10.1 |
| 2008/0306650 | A1* | 12/2008 | Nakagaki | 701/30 |
| 2009/0153312 | A1* | 6/2009 | Tanaka et al. | 340/426.1 |
| 2010/0332072 | A1 | 12/2010 | Ishiko et al. | |
| 2011/0160985 | A1* | 6/2011 | Yamaguchi | 701/112 |
| 2012/0197481 | A1 | 8/2012 | Takeda | |
| 2013/0006486 | A1* | 1/2013 | Shimizu et al. | 701/51 |
| 2014/0358360 | A1* | 12/2014 | Yasue | 701/31.7 |
| 2015/0021444 | A1* | 1/2015 | Goergen | 246/122 R |

FOREIGN PATENT DOCUMENTS

| | | | |
|---|---|---|---|
| JP | 2004-232498 | A | 8/2004 |
| JP | 2006-330827 | A | 12/2006 |
| JP | 2009-042867 | A | 2/2009 |
| JP | 2009-193395 | A | 8/2009 |
| JP | 2010-173494 | A | 8/2010 |

OTHER PUBLICATIONS

Office Action mailed Apr. 21, 2015 issued in corresponding JP patent application No. 2013-113188 (and English translation).

* cited by examiner

*Primary Examiner* — Thomas Tarcza
*Assistant Examiner* — Richard Goldman
(74) *Attorney, Agent, or Firm* — Posz Law Group, PLC

(57) ABSTRACT

An in-vehicle control system includes an in-vehicle control apparatus and a different in-vehicle apparatus communicably connected with each other. The different in-vehicle apparatus outputs detection data including a vehicle signal, result information indicating a diagnostic result of a self-diagnostic process, and time information indicating elapsed time measured from an appearance of an abnormal symptom in the vehicle signal. The in-vehicle control apparatus stores at least the vehicle signal as preliminary analysis data in a first storage in time series, and reads out, from the first storage, one preliminary analysis data upon a confirmation of an abnormality detection data including the result information indicating abnormality occurrence. The readout data is stored prior to a confirmation time of the abnormality detection data by the measured elapsed time. Then, the in-vehicle control apparatus stores the readout data in a second storage as an analysis data.

12 Claims, 4 Drawing Sheets

| | 9s | 8s | 7s | 6s |
|---|---|---|---|---|
| FIRST DATA | | | | |
| SECOND DATA | | | | |
| THIRD DATA | | | | |
| FOURTH DATA | | | | |
| FIFTH DATA | | | | |
| SIXTH DATA | | | | |
| SEVENTH DATA | | | | |

| | 9s | 8s | 7s | 6s | | | 1s |
|---|---|---|---|---|---|---|---|
| FIRST DATA | | | | | | | |
| SECOND DATA | | | | | | | |
| THIRD DATA | | | | | | | |
| FOURTH DATA | | | | | | | |
| FIFTH DATA | | | | | | | |
| SIXTH DATA | | | | | | | |
| SEVENTH DATA | | | | | | | |

| | 9s | 8s | 7s | 6s |
|---|---|---|---|---|
| FIRST DATA | | | | |
| SECOND DATA | | | | |
| THIRD DATA | | | | |
| FOURTH DATA | | | | |
| FIFTH DATA | | | | |
| SIXTH DATA | | | | |
| SEVENTH DATA | | | | |

IN-VEHICLE CONTROL SYSTEM AND IN-VEHICLE CONTROL APPARATUS

CROSS REFERENCE TO RELATED APPLICATION

This application is based on Japanese Patent Application No. 2013413188 filed on May 29, 2013, the disclosure of which is incorporated herein by reference.

TECHNICAL FIELD

The present disclosure relates to an in-vehicle control system and an in-vehicle control apparatus that store, in a backup storage, analysis data utilized in an analysis of an abnormality reason.

BACKGROUND

As disclosed in JP 2004-232498 A, an in-vehicle control apparatus stores, in a backup storage, analysis data utilized in an analysis of an abnormality occurred to a vehicle.

The in-vehicle control apparatus disclosed in JP 2004-232498 A includes a central processing unit (CPU), a random access memory (RAM), a backup RAM. The backup RAM functions as the backup storage. The control apparatus is connected with various sensors. The CPU acquires various respective detection data from the various sensors, and temporarily stores the detection data in the RAM. The CPU executes a self-diagnostic process in order to detect an abnormality occurred to the vehicle.

The various detection data temporarily stored in the RAM are treated as data necessary to be backed up. Thus, the various detection data temporarily stored in the RAM are stored in the backup RAM at predetermined time intervals. That is, the various detection data temporarily stored in the RAM are backed up in the backup RAM at predetermined time intervals. The control apparatus divides the various detection data stored in the RAM into several data groups based on a changing amount of each detection data with respect to time. Then, the control apparatus stores each data group in the backup RAM at predetermined time intervals. The predetermined time interval is set for each data group.

The control apparatus stores each data group in a first storing section of the backup RAM at the predetermined time intervals set for each data group before an abnormality is detected by the self-diagnostic process. When an abnormality occurrence is detected by the self-diagnostic process, the control apparatus stores each data group in a second storing section of the backup RAM. Then, the control apparatus stores each data group in a third storing section of the backup RAM at the predetermined time intervals set for each data group.

As another example different from the configuration disclosed in JP 2004-232498 A, an in-vehicle control apparatus may be connected to a different in-vehicle apparatus, which performs a self-diagnostic process based on detected vehicle signals and outputs the detected vehicle signals to the in-vehicle control apparatus. In this configuration, the in-vehicle control apparatus acquires, from the different in-vehicle apparatus, detection data that includes vehicle signals and diagnostic result of the self-diagnostic process. Thus, the in-vehicle control apparatus need not necessarily perform the self-diagnostic process. When the detection data acquired from the different in-vehicle apparatus includes the diagnostic result indicating an occurrence of the abnormality, the in-vehicle control apparatus may store, in a backup storage, the vehicle signals included in the detection data as the analysis data to be utilized in an analysis of an abnormality reason.

Usually, vehicle signals acquired at an appearance time of an abnormal symptom is effective and useful for an analysis of the abnormality reason. The above-described in-vehicle control apparatus may fail to store the effective and useful data for analyzing the abnormality reason in the backup storage.

SUMMARY

In view of the foregoing difficulties, it is an object of the present disclosure to provide an in-vehicle control system and an in-vehicle control apparatus each of which stores effective and useful analysis data for an analysis of an abnormality reason in a backup storage.

According to a first aspect of the present disclosure, an in-vehicle control system includes an in-vehicle control apparatus and a different in-vehicle apparatus communicably connected with the in-vehicle control apparatus. The different in-vehicle apparatus includes an output unit and a diagnostic unit. The output unit outputs, to the in-vehicle control apparatus, a vehicle signal to be utilized in a control process performed by the in-vehicle control apparatus. The diagnostic unit performs a self-diagnostic process based on the vehicle signal to determine an occurrence of an abnormality to a vehicle. The diagnostic unit measures an elapsed time upon an appearance of an abnormal symptom in the vehicle signal. The output unit outputs a plurality of detection data at predetermined time intervals, and each of the plurality of detection data includes the vehicle signal, result information indicating a diagnostic result of the self-diagnostic process performed by the diagnostic unit, and time information indicating the elapsed time measured by the diagnostic unit. One of the plurality of detection data includes the result information indicating the occurrence of the abnormality as the diagnostic result is referred to as an abnormality detection data. The in-vehicle control apparatus includes a processing unit, a first storage, and a second storage. The processing unit acquires the plurality of detection data output from the output unit of the different in-vehicle apparatus and performs the control process based on the vehicle signal included in each of the plurality of detection data. The first storage is capable of storing a data during a powered state of the in-vehicle control apparatus. The second storage is capable of storing a data during both the powered state of the in-vehicle control apparatus and a non-powered state of the in-vehicle control apparatus. The processing unit includes a storing section and a backup section. The storing section stores a plurality of preliminary analysis data in the first storage in time series, and each of the plurality of preliminary analysis data at least includes the vehicle signal included in corresponding one of the plurality of detection data. The backup section reads out, from the first storage, one of the plurality of preliminary analysis data as a reference data upon a confirmation of the abnormality detection data. The one of the plurality of preliminary analysis data is stored in the first storage at a time point prior to a confirmation time point of the abnormality detection data by the elapsed time indicated by the time information of the abnormality detection data. The backup section stores the reference data in the second storage as an analysis data.

With the above system, the analysis data effective and useful for an analysis of an abnormality reason can be stored in a backup storage.

According to a second aspect of the present disclosure, an in-vehicle control system includes an in-vehicle control apparatus, and a different in-vehicle apparatus communicably connected with the in-vehicle control apparatus. The different in-vehicle apparatus includes an output unit and a diagnostic unit. The output unit outputs, to the in-vehicle control apparatus, a vehicle signal to be utilized in a control process performed by the in-vehicle control apparatus. The diagnostic unit determines whether an abnormal symptom appears in the vehicle signal and performs a self-diagnostic process based on the vehicle signal to determine an occurrence of an abnormality to a vehicle. The output unit outputs a plurality of detection data at predetermined time intervals, and each of the plurality of detection data includes the vehicle signal, result information indicating a diagnostic result of the self-diagnostic process performed by the diagnostic unit, and symptom information indicating whether the abnormal symptom appears in the vehicle signal. One of the plurality of detection data includes the result information indicating the occurrence of the abnormality as the diagnostic result is referred to as an abnormality detection data. The in-vehicle control apparatus includes a processing unit, a first storage, and a second storage. The processing unit acquires the plurality of detection data output from the output unit of the different in-vehicle apparatus and performs the control process based on the vehicle signal included in each of the plurality of detection data. The first storage is capable of storing a data during a powered state of the in-vehicle control apparatus. The second storage is capable of storing a data during both the powered state of the in-vehicle control apparatus and a non-powered state of the in-vehicle control apparatus. The processing unit includes a storing section and a backup section. The storing section stores a plurality of preliminary analysis data in the first storage, and each of the plurality of preliminary analysis data at least includes the vehicle signal and the symptom information included in corresponding one of the plurality of detection data. The vehicle signal and the symptom information are stored in the first storage associated with each other. The backup section reads out, from the first storage, one of the plurality of preliminary analysis data as a reference data upon a confirmation of the abnormality detection data. The one of the plurality of preliminary analysis data includes the symptom information indicating the appearance of the abnormal symptom in the vehicle signal. The backup section stores the reference data in the second storage as an analysis data.

With the above system, the analysis data effective and useful or an analysis of an abnormality reason can be stored in a backup storage.

According to a third aspect of the present disclosure, an in-vehicle control apparatus, which is communicably connected with a different in-vehicle apparatus that performs a self-diagnostic process, includes a processing unit, a first storage, and a second storage. The processing unit acquires, from the different in-vehicle apparatus, a plurality of detection data at predetermined time intervals. Each of the plurality of detection data includes a vehicle signal to be utilized in a control process, result information indicating a diagnostic result of the self-diagnostic process performed by the different in-vehicle apparatus, and time information indicating an elapsed time measured by the different in-vehicle apparatus upon an appearance of an abnormal symptom in the vehicle signal. The processing unit performs the control process based on the vehicle signal included in each of the plurality of detection data. One of the plurality of detection data including the result information indicating an occurrence of an abnormality to a vehicle as the diagnostic result being referred to as an abnormality detection data. The first storage is capable of storing a data during a powered state of the in-vehicle control apparatus. The second storage is capable of storing a data during both the powered state of the in-vehicle control apparatus and a non-powered state of the in-vehicle control apparatus. The processing unit includes a storing section and a backup section. The storing section stores a plurality of preliminary analysis data in the first storage in time series. Each of the plurality of preliminary analysis data at least includes the vehicle signal included in corresponding one of the plurality of detection data. The backup section reads out, from the first storage, one of the plurality of preliminary analysis data as a reference data upon a confirmation of the abnormality detection data. The one of the plurality of preliminary analysis data being stored in the first storage at a time point prior to a confirmation time point of the abnormality detection data by the elapsed time indicated by the time information of the abnormality detection data. The backup section stores the reference data in the second storage as an analysis data.

With the above apparatus, the analysis data effective and useful for an analysis of an abnormality reason can be stored in a backup storage.

According to a fourth aspect of the present disclosure, an in-vehicle control apparatus, which is communicably connected with a different in-vehicle apparatus that performs a diagnostic process, includes a processing unit, a first storage, and a second storage. The processing unit acquires, from the different in-vehicle apparatus, a plurality of detection data at predetermined time intervals. Each of the plurality of detection data includes a vehicle signal to be utilized in a control process, result information indicating a diagnostic result of the self-diagnostic process performed by the different in-vehicle apparatus, and symptom information indicating whether an abnormal symptom appears in the vehicle signal. The processing unit performs the control process based on the vehicle signal included in each of the plurality of detection data. One of the plurality of detection data includes the result information indicating an occurrence of an abnormality to a vehicle as the diagnostic result is referred to as an abnormality detection data. The first storage is capable of storing a data during a powered state of the in-vehicle control apparatus. The second storage is capable of storing a data during both the powered state of the in-vehicle control apparatus and a non-powered state of the in-vehicle control apparatus. The processing unit includes a storing section and a backup section. The storing section stores a plurality of preliminary analysis data in the first storage. Each of the plurality of preliminary analysis data at least includes the vehicle signal and the symptom information included in corresponding one of the plurality of detection data. The vehicle signal and the symptom information are stored in the first storage associated with each other. The backup section reads out, from the first storage, one of the plurality of preliminary analysis data as a reference data upon a confirmation of the abnormality detection data. The one of the plurality of preliminary analysis data includes the symptom information indicating the appearance of the abnormal symptom in the vehicle signal. The backup section stores the reference data in the second storage as an analysis data.

With the above apparatus, the analysis data effective and useful for an analysis of an abnormality reason can be stored in a backup storage.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

The following will describe embodiments of the present disclosure with reference to accompanying drawings.

First Embodiment

Figures 1, 2, 3:
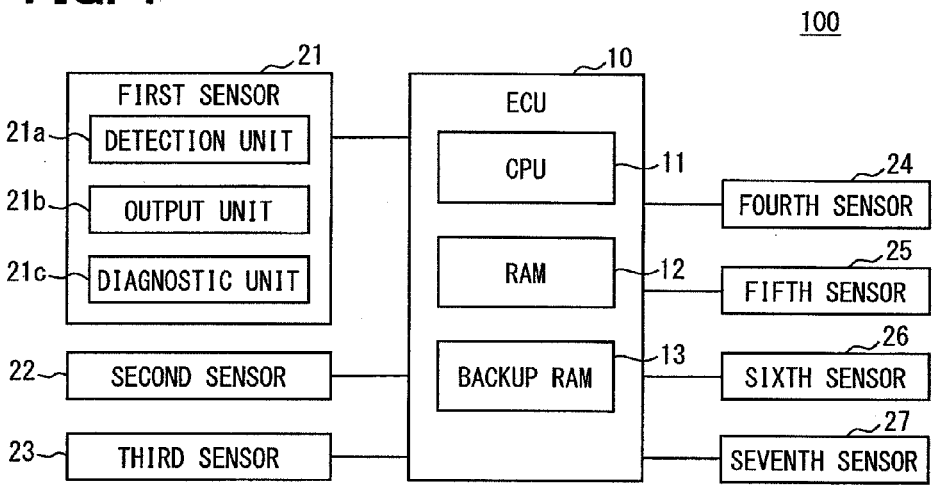
FIG. 1 is a block diagram showing a configuration of an in-vehicle control system according to a first embodiment of the present disclosure.
FIG. 2 is a diagram showing a configuration of data stored in a PAM of the in-vehicle control system.
FIG. 3 is a diagram showing a configuration of data stored in a backup RAM of the in-vehicle control system.

An ECU 10 according to a first embodiment and an in-vehicle control system 100 including the ECU 10 will be described with reference to FIG. 1 to FIG. 6. As shown in FIG. 1, the in-vehicle control system 100 equipped to a vehicle includes the ECU 10, a first sensor 21, a second sensor 22, a third sensor 23, a fourth sensor 24, a fifth sensor 25, a sixth sensor 26, and a seventh sensor 27. The first sensor 21 to the seventh sensor 27 are connected with the ECU 10. Hereinafter, when there s no need to distinguish each of the first sensor 21 to the seventh sensor 27, the first sensor 21 to the seventh sensor 27 are also referred to as sensors 21 to 27. Each of the sensors 21 to 27 is connected with the ECU 10 via a communication line, and is communicable with the ECU 10 via a controller area network (CAN) communication or a serial communication.

In the present disclosure, the ECU 10 functions as an example of an in-vehicle control apparatus. The ECU 10 includes a microcomputer (not shown), which has a CPU 11, a RAM 12, and a backup RAM 13 as shown in FIG. 1. Hereinafter, the backup RAM 13 is also referred to as a BRAM 13. A power required for an operation of the. ECU 10 is provided by a power source (not shown), such as a battery equipped to the vehicle.

The CPU 11 acquires detection data output from each of the sensors 21 to 27, and performs a control process based on a sensing value included in the detection data. In the present disclosure, the CPU 11 functions as an example of a processing unit. Each sensing value detected by each of the sensors 21-27 is also referred to as a vehicle signal. The CPU 11 performs a storing process and a backup process. The storing process and the backup process will be described later in detail.

The RAM 12 is provided by a volatile memory that maintains stored data while the ECU 10 is supplied with power. In the present disclosure, the RAM 12 functions as an example of a first storage. In the present disclosure, the RAM 12 is intermittently supplied with power. More specifically, the RAM 12 is able to store data while the ECU 10 is supplied with power, and cannot store data while the ECU 10 is not supplied with power. Thus, when the power supply of the ECU 10 is interrupted, the data stored in the RAM 12 during a powered state of the ECU 10 is lost. Hereinafter, the powered state of the ECU 10 is a state in which power is supplied to the ECU 10, and a non-powered state of the ECU 10 is a state in which power is not supplied to the ECU 10. The BRAM 13 may be configured to be able to store data while an ignition switch of the vehicle is in an on state. When the ignition switch is turned off from the on state, the data stored in the BRAM 13 may be lost. A memory size of the RAM 12 is larger than a memory size of the BRAM 13. For example, the RAM 12 may be provided by a ring buffer.

For example, as shown in FIG. 2, the RAM 12 may store the first data to the seventh data respectively output from the first sensor 21 to the seventh sensor 27 in time series. Hereinafter, the first data to the seventh data stored in the RAM at the same time is also referred to as a detection data set. That is, the RAM 12 stores multiple detection data sets in time series. The CPU 11 performs the storing process in order to store the detection data set including the first data to the seventh data in the RAM 12. The CPU 11 is able to recognize the multiple detection data sets. For example, the CPU 11 is able to recognize the detection data set stored one second (1 s) ago from the present time, the detection data set stored two seconds (2 s) ago from the present time, the detection data set stored three seconds (3 s) ago from the present time, the detection data set stored four seconds (4 s) ago from the present time, the detection data set stored five seconds (5 s) ago from the present time, the detection data set stored six seconds (6 s) ago from the present time, the detection data set stored seven seconds (7 s) ago from the present time, the detection data set stored eight seconds (8 s) ago from the present time, and the detection data set stored nine seconds (9 s) ago from the present time. Since each detection data included in the detection data set may be used in abnormality analysis, each detection data included in the detection data set is also referred to as preliminary analysis data. The CPU 11 performs a data management to the multiple preliminary analysis data based on a storing order of each preliminary analysis data in the RAM 12. More specifically, the CPU 11 performs the data management to the multiple preliminary analysis data based on a storing time of each preliminary analysis data in the RAM 12.

In FIG. 2, the first data is output from the first sensor 21. Similarly, the second data is output from the second sensor 22, the third data is output from the third sensor 23, the fourth data is output from the fourth sensor 24, the fifth data is output from the fifth sensor 25, the sixth data is output from the sixth sensor 26, and the seventh data is output from the seventh sensor 27.

In the example shown in FIG. 2 the CPU 11 stores, in the RAM 12, one detection data set including the first data to the seventh data respectively output from the first sensor 21 to the seventh sensor 27 every one second. In the example shown in FIG. 2, the RAM 12 is configured to store nine detection data sets. Thus, the RAM 12 stores nine detection data sets acquired during nine seconds prior to the present time. The nine detection data sets include the detection data set acquired one second ago from the present time to the detection data set acquired nine seconds ago from the present time. When memory regions of the RAM 12 for storing the detection data sets are full, the oldest detection data set stored in one memory region is deleted, and the latest detection data set is stored in the memory region. For example, in the configuration shown in FIG. 2, when the nine memory regions of the RAM 12 are full, the detection data set stored nine seconds ago is deleted from the corresponding memory region, and the latest detection data set is stored in the memory region. That is, the detection data set stored nine seconds ago is rewritten by the latest detection data set.

Each of the first data to the seventh data stored in the RAM 12 at least includes the sensing value detected by the corresponding one of the sensor 21 to 27. That is, each of the first data to the seventh data may include only the sensing value of the detection data output from the corresponding one of the sensors 21 to 27. As another example, each of the first data to the seventh data may include the whole detection data output from the corresponding one of the sensor 21 to 27. Each of the first data to the seventh data stored in the RAM 12 is stored as the preliminary analysis data. Hereinafter, the preliminary analysis data is simply referred to as preliminary data. That is, the RAM 12 stores multiple preliminary data in time series, and each of the multiple preliminary data includes at least the sensing value output from the corresponding one of the sensors 21 to 27.

The BRAM 13 is able to store data while the ECU 10 is supplied with power. The BRAM 13 is also able to store data while the ECU 10 is not supplied with power. That is, the BRAM 13 is able to store data during both the powered state of the ECU 10 and the non-powered state of the ECU 10. The BRAM 13 functions as an example of a second storage. The BRAM 13 is constantly supplied with power. The BRAM 13 is able to maintain stored data even when the power supply is interrupted. For example, by receiving a power supply from a power source (not shown), the BRAM 13 may be configured to store data even when the ignition switch is turned off from the on state. The second storage may also be provided by an electrically erasable and programmable read only memory (EEPROM) that is able to store data regardless of a power supply.

As shown in FIG. 3, the BRAM 13 stores a part of the multiple detection data sets stored in the RAM 12. More specifically, the CPU 11 performs the backup process in order to store, in the BRAM 13, only the detection data sets, which are selected from the multiple detection data sets stored in the RAM 12 and are necessary for the analysis of the abnormality reason. That is, among the multiple detection data sets stored in the RAM 12, only the detection data sets necessary for the analysis of the abnormality reason are backed up in the RAM 12. As shown in FIG. 3, the BRAM 13 stores four detection data sets including the detection data set stored six seconds ago to the detection data set stored nine seconds ago.

The detection data sets stored in the BRAM 13 includes the detection data sets acquired at an appearance time of the abnormal symptom in the sensing value and one or more detection data sets acquired before and after the appearance time of the abnormal symptom in the sensing value. That is, the detection data sets stored in the BRAM 13 includes the detection data sets acquired at the appearance time of the abnormal symptom in the sensing value, the detection data sets acquired during a predetermined period right before the appearance time of the abnormal symptom, and the detection data sets acquired during a predetermined period right after the appearance time of the abnormal symptom. Each of the detection data stored in the BRAM 13 is also referred to as analysis data. Each of the first data to the seventh data included in each detection data set stored in the BRAM 13 is provided by, for example, a freeze frame data (FFD).

Each of the sensors 21 to 27 functions as an example of a different in-vehicle apparatus. The first to seventh sensors 21 to 27 may be provided by various sensors equipped to the vehicle. For example, the various sensors may include an internal temperature sensor detecting a temperature inside a compartment of the vehicle, a water temperature sensor provided at an engine of the vehicle to detect a temperature of engine cooling water, an external temperature sensor detecting an outside temperature of the vehicle, an evaporator temperature sensor detecting a temperature of an evaporator of the vehicle, an exhaust gas detecting sensor, a humidity sensor, a motor position detecting sensor, a temperature sensor detecting a temperature of air flow at an air outlet, an accelerometer, and an occupant detection sensor. The sensors 21 to 27 have similar functional configurations and perform similar operations although each of the sensors 21 to 27 has a different detection target. The following will describe configurations of the sensors 21 to 27 with the first sensor 21 as a representative example.

As shown in FIG. 1, the first sensor 21 includes a detection unit 21*a*, an output unit 21*b*, and a diagnostic unit 21*c*. The detection unit 21*a* performs detection to the detection target and generates the sensing value related to the detection target. The output unit 21*b* outputs detection data including the sensing value generated in the detection unit 21*a*. The diagnostic unit 21*c* performs the self-diagnostic process based on the sensing value detected by the detection unit 21*a* in order to determine whether an abnormality is occurred to the vehicle. The diagnostic unit 21*c* may be provided by a CPU. In addition to the self-diagnostic process, the diagnostic unit 21*c* may further perform a measuring process to measure an elapsed time from the appearance of the abnormal symptom in the sensing value.

As described above, the first sensor 21 performs the detection to the detection target, and outputs the sensing value as a detection result. Further, the first sensor 21 performs the self-diagnostic process based on the sensing value. Thus, the first sensor 21 is also referred to as an intelligent sensor. The operation of the first sensor 21 will be described later in detail.

In the present disclosure, the in-vehicle control system 100 has seven sensors including the first sensor 21 to the seventh sensor 27. The in-vehicle control system 100 may also include only one sensor or predetermined quantity of sensors other than seven. For example, the in-vehicle control system 100 may have only the first sensor 21. In this configuration, only the first data output from the first sensor 21 is stored in the RAM 12 every one second. That is, the detection data set includes only the first data.

In the present disclosure, each of the sensors 21 to 27 is provided as the different in-vehicle apparatus. The different in-vehicle apparatus is not limited to the first sensor 21 to the seventh sensor 27. For example, the different in-vehicle apparatus may include an actuator, a controller, and an ECU other than the ECU 10.

Each of the sensors 21 to 27 may set a diagnostic code corresponding to the diagnostic result. In this configuration, each of the first data to the seventh data may include the diagnostic code. For example, the diagnostic code may be provided by a diagnostic trouble code (DTC), and is also referred to as a malfunction code.

Figure 4:
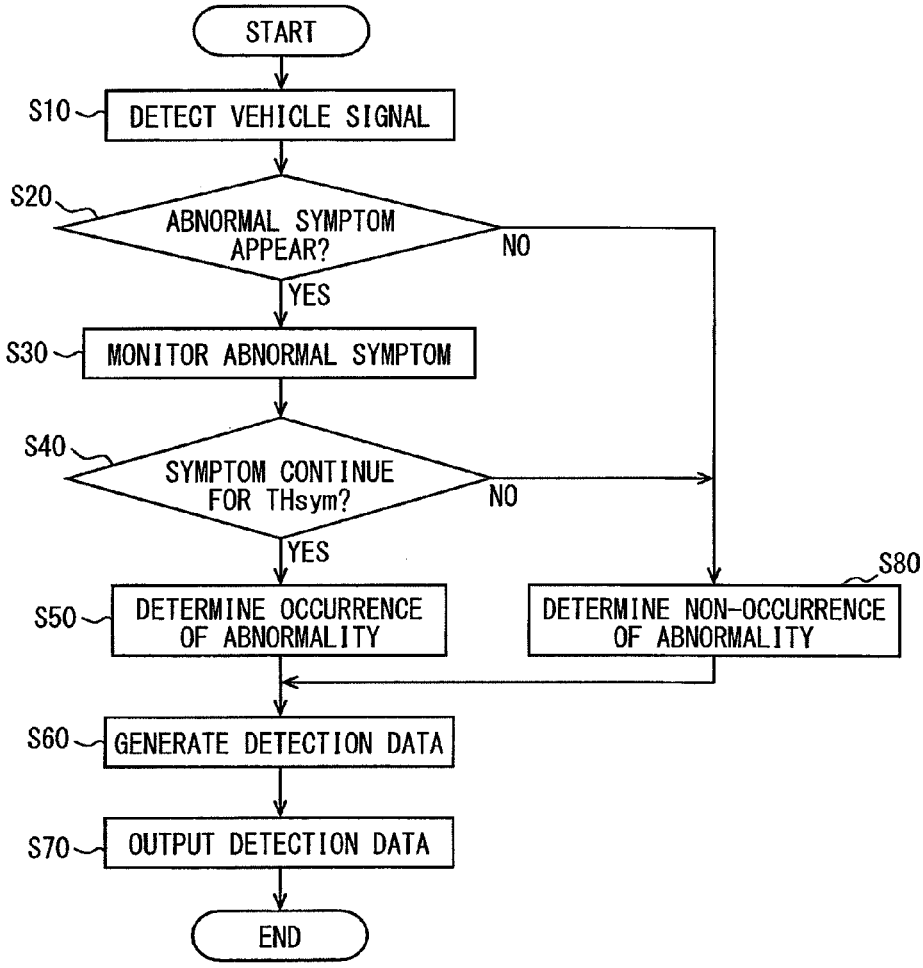
FIG. 4 is a flowchart showing a process executed by a first sensor of the in-vehicle control system.
Figure 5:
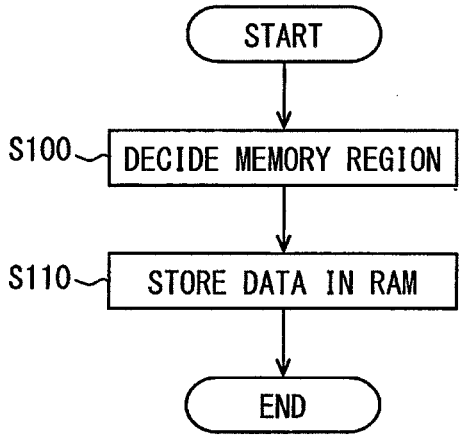
FIG. 5 is a flowchart showing a storing process executed by an electronic control unit (ECU) of the in-vehicle control system.
Figure 6:
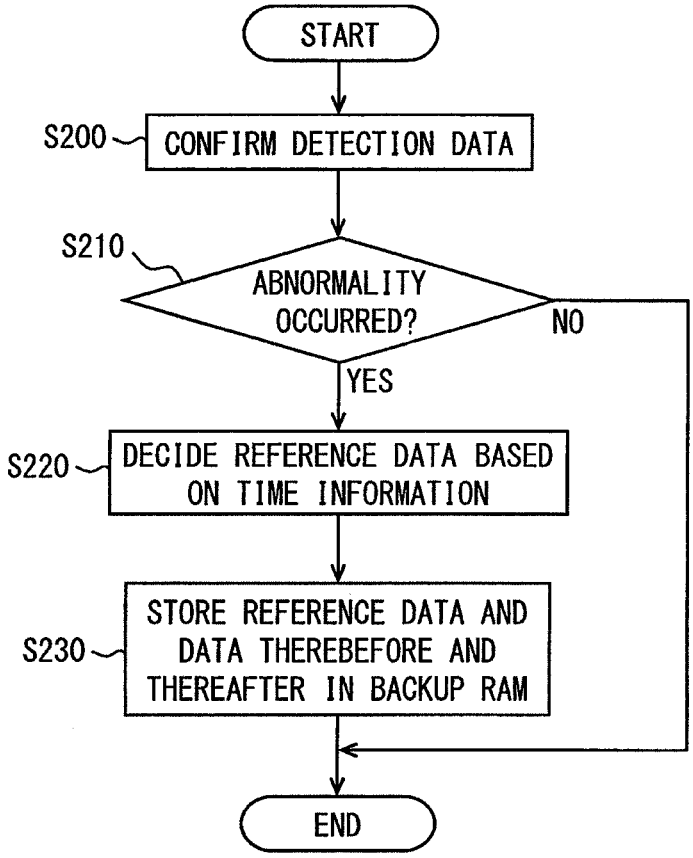
FIG. 6 is a flowchart showing a backup process executed by the ECU of the in-vehicle control system.

The following will describe an operation of the ECU 10 and operations of the first sensor 21 to the seventh sensor 27 with reference to FIG. 4 to FIG. 6.

First, the operation of the first sensor 21 will be described with reference to FIG. 4. The first sensor 21 executes a process shown in FIG. 4 at predetermined time intervals.

At S10, the detection unit 21*a* of the first sensor 21 performs a detection process and generates a sensing value. At S20, the first sensor 21 determines whether the abnormal symptom has appeared. Specifically, the diagnostic unit 21*c* of the first sensor 21 determines whether the abnormal symptom has appeared in the sensing value detected at S10 by the detection unit 21*a*. When the sensing value reaches a predetermined threshold value, the diagnostic unit 21*c* determines that the abnormal symptom has appeared in the sensing value. When the sensing value does not reach the predetermined threshold value, the diagnostic unit 21*c* determines that there is no abnormal symptom in the sensing value. When the diagnostic unit 21*c* determines that the abnormal symptom has appeared in the sensing value (S20: YES), the first sensor proceeds to S30. When the diagnostic unit 21*c* determines that the sensing value has no abnormal symptom (S20: NO), the first sensor proceeds to S80. The first sensor 21 starts the self-diagnostic process by determining whether the abnormal symptom has appeared or not in the sensing value detected at S10.

At S80, the first sensor 21 determines a nonoccurrence of the abnormality. That is, since no abnormal symptom has appeared in the sensing value detected at S10, the diagnostic unit 21*c* determines that no abnormality has occurred to the vehicle. In this case, the diagnostic unit 21*c* outputs the non-occurrence of the abnormality as the diagnostic result of the self-diagnostic process.

At S30, the first sensor 21 monitors whether the abnormal symptom appeared in the sensing value continues to appear for a predetermined period (THsym). The predetermined period corresponds to a determination period to determine the occurrence of the abnormality. In the present embodiment, the determination period is set to 7 seconds as an example.

The diagnostic unit 21*c* performs a measuring process in order to measure the elapsed time from the appearance of the abnormal symptom in the sensing value. The diagnostic unit 21*c* starts to measure the elapsed time upon the appearance of the abnormal symptom in the sensing value. Specifically, the diagnostic unit 21*c* starts to measure the elapsed time when the sensing value switches from a normal state to an abnormal state. Herein, the normal state is a state in which no abnormal symptom appears in the sensing value, and the abnormal state is a state in which the abnormal symptom appears in the sensing value. After the diagnostic unit 21*c* starts the measuring process, the diagnostic unit 21*c* continues to measure the elapsed time while the sensing value continues to stay in the abnormal state. After the diagnostic unit 21*c* starts the measuring process, when the sensing value switches from the abnormal state to the normal state, the diagnostic unit 21*c* stops measuring of the elapsed time and dears the measured elapsed time. The normal state in which no abnormal symptom appears in the sensing value is a state in which the sensing value does not reach the threshold value. The abnormal state in which the abnormal symptom appears in the sensing value is a state in which the sensing value reaches the threshold value.

At S40, the first sensor 21 determines whether the abnormal symptom has appeared for the predetermined period in the sensing value. When the diagnostic unit 21*c* determines, based on a monitoring result at S30, that the abnormal symptom has continued to appear for the predetermined period, the first sensor 21 proceeds to S50. When the diagnostic unit 21*c* determines, based on the monitoring result at S30, that the abnormal symptom does not continue to appear for the predetermined period, the first sensor 21 proceeds to S80.

At S50, the first sensor 21 determines an occurrence of the abnormality. Specifically, after the diagnostic unit 21*c* starts the measuring process, when the abnormal state of the sensing value continues for the predetermined period, that is the measured elapsed time reaches the predetermined period, the diagnostic unit 21*c* determines that the abnormality has occurred. The diagnostic unit 21*c* starts to measure the elapsed time when the abnormal symptom appears in the sensing value. When the sensing value fails to return to the normal state until the elapsed time reaches the determination period, the diagnostic unit 21*c* determines that the abnormality has occurred. In this case, the diagnostic unit 21*c* outputs the occurrence of the abnormality as the diagnostic result of the self-diagnostic process. As described above, the diagnostic unit 21*c* determines the occurrence of the abnormality when the abnormal state of the sensing value continues for the predetermined period. Thus, the predetermined period is also referred to as a required period for the malfunction diagnosis. The predetermined period is also a time elapsed from the appearance of the abnormal symptom until the determination of the occurrence of the abnormality as the diagnostic result. When the first sensor 21 determines the occurrence of the abnormality in the self-diagnostic process, the first sensor 21 performs a fail-safe process, and sets the sensing value to a predetermined set value.

At S60, the first sensor 21 generates the detection data. Specifically, the diagnostic unit 21*c* of the first sensor 21 generates the detection data. The detection data includes the sensing value that is detected by the detection unit 21*a*, diagnostic result information indicating the diagnostic result of the self-diagnostic process, and time information indicating the measured elapsed time. Hereinafter, the diagnostic result information is also referred to as result information for simplification. When the diagnostic unit 21*c* determines the occurrence of the abnormality at S50, the diagnostic unit 21*c* generates the detection data so that the detection data includes the sensing value at the time when the occurrence of the abnormality is determined, the result information indicating the occurrence of the abnormality, and the time information indicating the elapsed time from the appearance of the abnormal symptom in the sensing value. The sensing value acquired at the time when the occurrence of the abnormality is determined corresponds to the sensing value detected at S10. When the diagnostic unit 21*c* determines the non-occurrence of the abnormality at S80, the diagnostic unit 21*c* generates the detection data so that the detection data includes the sensing value at the time when the non-occurrence of the abnormality is diagnosed, the result information indicating the non-occurrence of the abnormality, and the time information indicating the elapsed time. In this case, the elapsed time is set to zero. The sensing value acquired at the time when the non-occurrence of the abnormality is diagnosed corresponds to the sensing value detected at S10.

At S70, the first sensor 21 outputs the detection data. Specifically, the output unit 21*b* of the first sensor 21 outputs the detection data generated at S60. That is, the first sensor 21 transmits the detection data generated at S60 to the ECU 10. The output unit 21*b* outputs the detection data at predetermined time intervals. The detection data includes the sensing value, the result information indicating the diagnostic result of the self-diagnostic process, and the time information indicating the elapsed time. That is, the first sensor 21 outputs the detection data, which includes the sensing value, the result information indicating the diagnostic result of the self-diagnostic process, and the time information indicating the elapsed time, as the first data. Similarly, the second sensor 22 outputs the detection data as the second data, the third sensor 23 outputs the detection data as the third data, the fourth sensor 24 outputs the detection data as the fourth data, the fifth sensor 25 outputs the detection data as the fifth data, the sixth sensor 26 outputs the detection data as the sixth data, and the seventh sensor 27 outputs the detection data as the seventh data.

As described above, in the present embodiment, when the abnormal symptom appears in the sensing value, each of the sensors 21 to 27 starts to measure the elapsed time from. When the sensing value fails to return to the normal state until the elapsed time reaches the predetermined determination period, the sensor determines the occurrence of the abnormality. Herein, the normal state is a state in which the sensing value is within a normal value range and does not reach the predetermined threshold value. The present disclosure is not limited to the above-described configuration.

For example, after the sensing value reaches a first threshold value, the sensing value further reaches a second threshold value without returning to the normal state, the first sensor 21 may determine the occurrence of the abnormality. In this case, the diagnostic unit 21*c* may start to measure the elapsed time when the sensing value reaches the first threshold value. The diagnostic unit 21*c* may clear the measured elapsed time when the sensing value returns to the normal state. The diagnostic unit 21*c* may generate the detection data to include the time information indicating the elapsed time measured from a time when the sensing value reaches the first threshold value to a time when the sensing value reaches the second threshold value without returning to the normal state. The second threshold value is set different from the first threshold value. When the sensing value increases corresponding to the appearance of the abnormal symptom, the second threshold value is set greater than the first threshold value. When the sensing value decreases corresponding to the appearance of the abnormal symptom, the second threshold value is set smaller than the first threshold value.

The diagnostic unit 21*c* may determine the occurrence of the abnormality when the sensing value continuously reaches the threshold value by predetermined counts without returning to the normal state. In this case, the diagnostic unit 21*c* may start to measure the elapsed time when the sensing value reaches the threshold value for the first time. The diagnostic unit 21*c* measures the counts of the sensing value reaching the threshold value. The diagnostic unit 21*c* clears the measured counts and the measured elapsed time when the sensing value returns to the normal state. The diagnostic unit 21*c* may generate the detection data to include the time information indicating the elapsed time measured from a time when the sensing value reaches the threshold value for the first time to a time when the counts of the sensing value reaching the threshold value becomes equal to the predetermined counts without returning to the normal state.

As described above, the diagnostic unit 21*c* may be configured to determine the occurrence of the abnormality when a predetermined condition is satisfied after the abnormal symptom appears in the sensing value. That is, the occurrence of the abnormality is determined after the appearance of the abnormal symptom in the sensing value by the elapsed time. The diagnostic unit 21*c* outputs the detection data including the time information indicating the elapsed time that is necessary to determine the occurrence of the abnormality from the appearance of the abnormal symptom in the sensing value.

The following will describe the storing process executed by the ECU 10 with reference to FIG. 5. The ECU 10 executes the storing process shown in FIG. 5 at predetermined time intervals.

At S100, the ECU 10 decides a memory region. Specifically, the CPU 11 of the ECU 10 decides the memory region of the RAM 12 to store the first data to the seventh data. That is, the CPU 11 of the ECU 10 decides an address of the memory region of the RAM 12 in order to store the first data to the seventh data in the RAM 12 in time series. For example, when a management of multiple memory regions of the RAM 12 is performed based on index, the CPU 11 increments an index of a memory region storing a latest preliminary data by one and sets a memory region corresponding to the incremented index as a present memory region. In the example shown in FIG. 2, each column labeled by the same time point is assigned with the same index. That is, in FIG. 2, the column labeled by the time point 1 s is assigned with the same index. Similarly, each of the columns labeled by the same time point 2 s to 9 s is assigned with the same index.

At S110, the CPU 11 stores at least the sensing value of the detection data as the preliminary data in the RAM 12 in time series. The CPU 11 stores the preliminary data in the memory region decided at S100. The CPU 11 stores the first data to the seventh data output from the first sensor 21 to the seventh sensor 27, respectively, in the decided memory region of the RAM as shown in FIG. 2. The CPU 11 may store, in the RAM 12, the result information and the time information of the detection data output from each sensor 21 to 27 together with the sensing value of the detection data as the preliminary data in time series. That is, the CPU 11 includes at least the sensing value in the preliminary data. The preliminary data may also include the result information, the time information and the sensing value in the preliminary data. When the detection data output from each of the sensors 21 to 27 includes the diagnostic code, the CPU may include the diagnostic code in the preliminary data and stores the preliminary data in the RAM 12. The process executed by the CPU 11 at S110 functions as an example of a storing section.

Each of the sensors 21 to 27 may output the first data to the seventh data at different timings. In this case, the ECU 10 may temporarily store the first data to the seventh data, which are output from the sensors 21 to 27 at different timings, in a receiving buffer (not shown). Then, at S110, the CPU 11 stores the first data to the seventh data that are stored in the receiving buffer in the RAM 12 at the same time.

The following will describe the backup process executed by the ECU 10 with reference to FIG. 6. The ECU 10 executes the backup process shown in FIG. 6 at predetermined time intervals.

At S200, the ECU 10 confirms the detection data set including the first data to the seventh data. Hereinafter, each of the first data to the seventh data included in the detection data set is also referred to as the detection data. Specifically, the ECU 10 confirms each detection data included in the latest detection data set.

At S210, the ECU 10 determines whether the abnormality has occurred or not. Specifically, the CPU 11 of the ECU 10 determines whether each detection data includes the result information indicating the occurrence of the abnormality. When the CPU 11 determines that the detection data includes the result information indicating the occurrence of the abnormality, the ECU 10 proceeds to S220. When the CPU 11 determines that the detection data includes the result information indicating the non-occurrence of the abnormality, the ECU 10 ends the backup process shown in FIG. 6.

At S220, the ECU 10 decides a reference data based on the time information. Specifically, the CPU 11 of the ECU 10 decides the reference data from the multiple preliminary data stored in the RAM 12 based on the time information included in the latest detection data confirmed at S200.

When the latest detection data includes the result information indicating the occurrence of the abnormality, the CPU 11 decides the preliminary data that is stored in the MM 12 prior to the latest detection data by the elapsed time as the reference data. Herein, the elapsed time is indicated by the time information of the latest detection data. Hereinafter, the detection data including the result information indicating the occurrence of the abnormality is also referred to as abnormality detection data. Among the multiple preliminary data stored in the RAM 12, the CPU 11 decides the preliminary data that is stored in the RAM 12 prior to the abnormality detection data by the elapsed time indicated by the time information of the abnormality detection data as the reference data. Herein, the elapsed time is a time period elapsed from the appearance of the abnormal symptom in the sensing value until the determination of the abnormality occurrence. Thus, the reference data is set as the detection data acquired when the abnormal symptom starts to appear in the sensing value.

For example, when the CPU 11 manages multiple memory regions of the RAM 12 based on the index, the CPU 11 decides a reference index at first. Specifically, the CPU 11 specifies the index that is prior to the index corresponding to the confirmed abnormality detection data by the elapsed time indicated by the time information of the abnormality detection data, and decides the specified index as the reference index. Then, the CPU 11 decides the preliminary data stored in the memory region indicated by the reference index as the reference data.

In the present embodiment, for example, the abnormality detection data confirmed at S200 includes the time information indicating the elapsed time of 7 seconds. Thus, in the example shown in FIG. 2, the CPU 11 decides the index labeled as 7 seconds (7 s) as the reference index, and decides the preliminary data stored in the column labeled as 7 s as the reference data.

At S230, in addition to the reference data, the CPU 11 further stores, in the BRAM 13, the preliminary data stored before and after the reference data. The CPU 11 reads out the reference data decided at S220 from the RAM 12. Further, the CPU 11 reads out the preliminary data stored in the RAM 12 before and after the reference data within a predetermined period from the RAM 12. Then, the CPU 11 stores, in the BRAM 13, the reference data and the preliminary data stored in the RAM 12 before and after the reference data within the predetermined period as the analysis data. That is, the CPU 11 stores, in the BRAM 13, the detection data acquired when the abnormal symptom appears in the sensing value and detection data acquired before and after the appearance of the abnormal symptom in the sensing value within the predetermined period as the analysis data.

As described above, when the latest detection data output from the sensor 21 to 27 includes the result information indicating the occurrence of the abnormality, the CPU 11 reads out, from the RAM 12, the preliminary data stored in the RAM 12 prior to the latest detection data by the elapsed time indicated by the time information of the latest detection data. Then, the CPU 11 stores, in the BRAM 13, the preliminary data read out from the RAM 12 as the analysis data. Thus, the process executed by the CPU 11 at S210, S220 and S230 function as an example of a backup section.

Further, in the present embodiment, the CPU 11 reads out the preliminary data stored 6 seconds ago, the preliminary data stored 7 seconds ago, the preliminary data stored 8 seconds ago, and the preliminary data stored 9 seconds ago. That is, in FIG. 2, the CPU 11 reads out the preliminary data stored in the columns labeled as 6 s, 7 s, 8 s, and 9 s. Then, the CPU 11 stores the multiple preliminary data read out from the RAM 12 in the BRAM 13 as the analysis data. As shown in FIG. 3 the preliminary data stored 6 seconds ago, the preliminary data stored 7 seconds ago, the preliminary data stored 8 seconds ago, and the preliminary data stored 9 seconds ago are read out from the RAM 12 and restored in the BRAM 13 as the analysis data. Further, the preliminary data stored 8 seconds ago and the preliminary data stored 9 seconds ago correspond to the preliminary data stored before the reference data, and the preliminary data stored 6 seconds ago correspond to the preliminary data stored after the reference data.

As described above, in the present disclosure, the preliminary data stored in the RAM 12 before and after the reference data within the predetermined time are stored in the BRAM 13 together with the reference data as the analysis data. Thus, an analysis accuracy of the abnormality can be improved. As another example, only the reference data may be stored in the BRAM 13 as the analysis data. In this case, the analysis accuracy of the abnormality can also be improved. That is, at S230 in FIG. 6, the CPU 11 may store only the reference data in the BRAM 13.

The analysis data stored in the BRAM 13 may be read out via a diagnostic tool at a vehicle shop, and are used to analyze the abnormality reason. Since the analysis of the abnormality reason is a well-known art, detailed description will be omitted.

As described above, each of the sensors 21 to 27 performs the self-diagnostic process based on the sensing value in order to determine the occurrence of the abnormality. Each of the sensors 21 to 27 measures the elapsed time after the abnormal symptom appears in the sensing value. Each of the sensors 21 to 27 outputs the detection data to the ECU 10 at predetermined time intervals. The detection data includes the sensing value, the result information indicating the diagnostic result of the self-diagnostic process, and the time information indicating the measured elapsed time.

The ECU 10 stores, in the RAM 12, at least the sensing value of each detection data output from each of the sensors 21 to 27 in time series as the analysis data. When the confirmed detection data includes the result information indicating the occurrence of the abnormality, the ECU 10 reads out the preliminary data stored in the RAM 12 prior to the confirmed detection data by the elapsed time ago. The elapsed time is indicated by the time information of the confirmed detection data that has the result information indicating the occurrence of the abnormality.

The elapsed time indicated by the time information of the abnormality detection data is measured from the appearance of the abnormal symptom in the sensing value. The ECU 10 reads out the preliminary data stored in the RAM 12 prior to the abnormality detection data by the elapsed time indicated by the time information of the abnormality detection data. Thus, the ECU 10 is able to read out the sensing value (preliminary data) acquired at a time when the abnormal symptom starts to appear in the sensing value. The sensing value acquired at the time when the abnormal symptom starts to appear is effective and useful for the analysis of the abnormality reason.

The ECU 10 stores, in the BRAM 13, the preliminary data read out from the RAM 12. The BRAM 13 is able to store data while the ECU 10 is in the powered state and is also able to store data while the ECU is in the non-powered state. The BRAM 13 functions as a backup storage. The ECU 10 stores, in the backup storage, the sensing value acquired at the time when the abnormal symptom starts to appear in the sensing value.

As described above, in the present embodiment, the in-vehicle control system 100 is able to store, in the BRAM 13, the analysis data that are effective and useful for the analysis of the abnormality reason even though each of the sensors 21 to 27 is configured to perform the self-diagnostic process. Similarly, the ECU 10 is able to store, in the BRAM 13, the analysis data that are effective and useful for analysis of the abnormality reason even though the ECU is configured to acquire the sensing value from each of the sensors 21 to 27 that performs the self-diagnostic process.

As described above, when the first sensor 21 determines the occurrence of the abnormality in the self-diagnostic process, the first sensor 21 performs the fail-safe process and may set the sensing value to the predetermined set value. In this case, the first sensor 21 may output the detection data including the predetermined set value as the sensing value. Since the predetermined set value is a settable value, when the sensing value is set to the predetermined set value, the sensing value may be no more effective and useful for the analysis of the abnormality reason. In the present disclosure, when the ECU 10 acquires the detection data including the predetermined set value as the sensing value, the ECU 10 further reads out the preliminary data stored in the RAM 12 prior to the detection data including the predetermined set value by the elapsed time ago and stores the readout preliminary data in the BRAM 13 as the analysis data. Herein, the elapsed time is indicated by the time information of the detection data that includes the predetermined set value as the sensing value. With above-described configuration, the in-vehicle control system 100 and the ECU 10 restricts storing the detection data, which includes the predetermined set value as the sensing value, in the BRAM 13 as the analysis data.

The CPU 11 may read out the preliminary data stored in the RAM 12 prior to the abnormality detection data by a cumulative period ago. Herein, the cumulative period is a sum of the elapsed time indicated by the time information of the abnormality detection data and a communication time required for a communication between the ECU 10 and the first sensor 21. That is, the CPU 11 sets the preliminary data stored in the RAM 12 prior to the abnormality detection data by the cumulative period ago as the reference data. Then, the CPU 11 stores the reference data read out from the RAM 12 in the BRAM 13 as the analysis data.

When the communication time between the ECU 10 and each sensor 21 to 27 is considered, the communication time of each sensor 21 to 27 may be stored in a non-volatile memory (not shown) of the ECU 10. With this configuration, the CPU 11 is able to set the reference data with consideration of the communication time between the ECU 10 and each of the sensors 21 to 27. With this configuration, the sensing value acquired accurately at the time when the abnormal symptom starts to appear in the sensing value can be stored in the BRAM 13.

The communication time between the ECU 10 and the first sensor 21 is a time necessary for the ECU 10 to receive the detection data transmitted by the first sensor 21. Thus, the communication time is also referred to as a communication delay time.

At S60 in FIG. 4, the diagnostic unit 21*c* may generate the detection data to include the time information indicating a sum of the measured elapsed time and the communication time with the ECU 10. In this case, at S70, the output unit 21*b* outputs the detection data to include the time information indicating the sum of the measured elapsed time and the communication time with the ECU 10. The communication time of the first sensor and the ECU 10 may be stored in a non-volatile memory (not shown) of the first sensor 21. With this configuration, the diagnostic unit 21*c* is able to generate the detection data that includes the time information indicating the sum of the measured elapsed time and the communication time with the ECU 10.

As described above, the reference data may also be decided with consideration of the communication time between the ECU 10 and the first sensor 21. Thus, the sensing value acquired accurately at the time when the abnormal symptom starts to appear in the sensing value can be stored in the BRAM 13.

Second Embodiment

The following will describe an ECU 10 according to a second embodiment and an in-vehicle control system 100 including the ECU 10 according to the second embodiment with reference to accompanying drawings.

The in-vehicle control system 100 according to the present embodiment is similar to the in-vehicle control system 100 according to the first embodiment in configuration. Thus, same reference symbol is used for same or equivalent part, and detailed description will be omitted.

The in-vehicle control system 100 according to the present embodiment is similar to the in-vehicle control system 100 according to the first embodiment in operation. Thus, the operation of the in-vehicle control system 100 according to the present embodiment similar to the operation of the in-vehicle control system 100 according to the first embodiment will be omitted, and different operation will be mainly described in the following.

The following will describe the operation of the first sensor 21 according to the present embodiment with reference to FIG. 4. The first sensor 21 executes the process shown in FIG. 4 at predetermined time intervals. At S20, when the diagnostic unit 21*c* determines that the abnormal symptom appears in the sensing value (S20: YES), the diagnostic unit 21*c* generates the detection data. In the present embodiment, the detection data further includes symptom information indicating whether the abnormal symptom appears in the sensing value or not. That is, the diagnostic unit 21*c* generates the detection data including the detected sensing value, the result information indicating the diagnostic result of the self-diagnostic process, and the symptom information indicating whether the abnormal symptom appears in the sensing value or not. In the present embodiment, the detection data may not include the time information indicating the elapsed time from the appearance of the abnormal symptom in the sensing value. At S70, the output unit 21*b* outputs the detection data generated by the diagnostic unit 21*c* at S60.

The following will describe a storing process executed by the ECU 10 according to the present embodiment with reference to FIG. 5. The ECU 10 executes the storing process shown in FIG. 5 at predetermined time intervals. As described above, the detection data output from the first sensor 21 includes the sensing value, the result information, and the symptom information. At S110, the CPU 11 stores, in the RAM 12, at least the sensing value and the symptom information as the preliminary data. Specifically, the CPU 11 stores the sensing value and the symptom information associated with each other. In the present embodiment, the CPU 11 has no need to store the preliminary data in time series.

Figure 7:
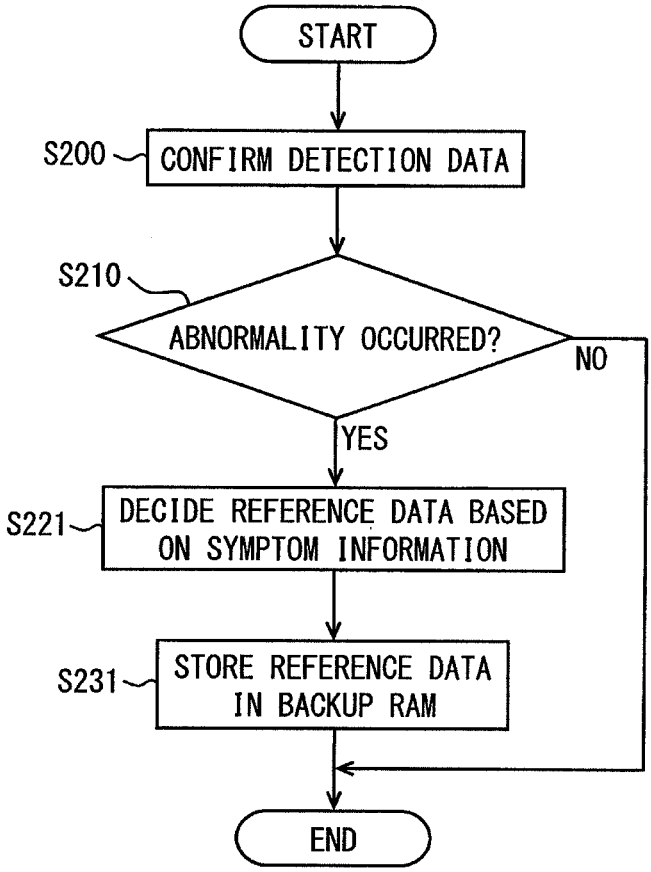
FIG. 7 is a flowchart showing a backup process executed by an ECU of an in-vehicle control system according to a second embodiment of the present disclosure.

The following will describe a backup process executed by the ECU 10 according to the present embodiment with reference to FIG. 7. The ECU 10 executes the storing process shown in FIG. 7 at predetermined time intervals, At S210, when the CPU 11 determines that the detection data includes the result information indicating the occurrence of the abnormality (S210: YES), the ECU 10 proceeds to S221. At S221, the ECU 10 decides a reference data based on the symptom information. Specifically, among the multiple preliminary data stored in the RAM 12, the CPU 11 reads out one preliminary data that includes the symptom information indicating the appearance of the abnormal symptom in the sensing value. Then, the CPU 11 sets the readout preliminary data as the reference data. Thus, the reference data corresponds to the detection data acquired at the time when the abnormal symptom starts to appear in the sensing value.

At S231, the CPU 11 stores the reference data in the BRAM 13. That is, the CPU 11 stores the detection data acquired at the time when the abnormal symptom appears in the sensing value as the analysis data in the BRAM 13.

As described above, each of the sensors 21 to 27 determines whether the abnormal symptom appears in the sensing value, and performs the self-diagnostic process in order to determine the occurrence of the abnormality. Then, each of the sensors 21 to 27 outputs the detection data at predetermined time intervals. The detection data includes the sensing value, the result information indicating the diagnostic result of the self-diagnostic process, and the symptom information indicating whether the abnormal symptom appears in the sensing value.

The ECU 10 stores at least the sensing value and the symptom information included in each detection data output from each of the sensors 21 to 27 in the RAM 12 as the preliminary data. The sensing value and the symptom information are stored in the RAM associated with each other. Then, when the ECU 10 acquires the detection data including the result information indicating the occurrence of the abnormality, the ECU 10 reads out one of the preliminary data from the RAM 12. Herein, the one of the preliminary data includes the symptom information indicating that the abnormal symptom appears in the sensing value. That is, the ECU 10 can read out the sensing value acquired at the time when the abnormal symptom appears in the sensing value. As described above, the sensing value acquired at the time when the abnormal symptom appears in the sensing value is effective and useful for the analysis of the abnormality reason.

The ECU 10 stores the readout preliminary data in the BRAM 13 as the analysis data. The BRAM 13 functions as the backup storage. That is, the ECU 10 stores the sensing value acquired at the time when the abnormal symptom appears in the sensing value in the backup storage.

The in-vehicle control system 100 according to the present embodiment provides advantages similar to the advantages provided by the in-vehicle control system 100 according to the first embodiment. The in-vehicle control system 100 according to the present embodiment provides the above-described advantages without storing the multiple preliminary data in time series in the RAM 12. That is, time series storing of the multiple preliminary data is not required in the in-vehicle control system 100 according to the present embodiment. The ECU 10 is able to store, in the BRAM 13, the analysis data that are effective and useful for the analysis of the abnormality reason even though the ECU is configured to acquire the sensing value from each of the sensors 21 to 27 that performs the self-diagnostic process.

In the present embodiment, the CPU 11 may store at least the sensing value and the symptom information included in each acquired detection data in time series in the RAM 12 as the preliminary data. Herein, the sensing value and the symptom information are stored in the RAM 12 associated with each other. That is, similar to the CPU 11 in the first embodiment, the CPU 11 according to the present embodiment may store the preliminary data in the RAM 12 in time series.

The CPU 11 according to the present embodiment reads out the reference data decided at S221 from the RAM 12. Further, the CPU 11 reads out the preliminary data stored in the RAM 12 before and after the reference data within a predetermined period from the RAM 12. Then, the CPU 11 stores the multiple preliminary data read out from the RAM 12 in the BRAM 13 as the analysis data. Thus, the process executed by the CPU 11 at S210, S221, S231 function as an example of the backup section. That is, the CPU 11 stores, in the BRAM 13, the detection data acquired when the abnormal symptom appears in the sensing value and detection data acquired before and after the appearance time of the abnormal symptom in the sensing value within the predetermined period as the analysis data. Thus, an analysis accuracy of the abnormality can be improved with the in-vehicle control system 100 and the ECU 10 according to the present embodiment.

While only the selected exemplary embodiments have been chosen to illustrate the present disclosure, it will be apparent to those skilled in the art from this disclosure that various changes and modifications can be made therein without departing from the scope of the disclosure as defined in the appended claims. Furthermore, the foregoing description of the exemplary embodiments according to the present disclosure is provided for illustration only, and not for the purpose of limiting the disclosure as defined by the appended claims and their equivalents.

What is claimed is:

1. An in-vehicle control system comprising:

an in-vehicle control apparatus; and a different in-vehicle apparatus communicably connected with the in-vehicle control apparatus, wherein the different in-vehicle apparatus includes:

an output unit outputting, to the in-vehicle control apparatus, a vehicle signal to be utilized in a control process performed by the in-vehicle control apparatus; and a diagnostic unit performing a self-diagnostic process based on the vehicle signal to determine an occurrence of an abnormality to a vehicle, the diagnostic unit measuring an elapsed time upon an appearance of an abnormal symptom in the vehicle signal, wherein the output unit outputs a plurality of detection data at predetermined time intervals, each of the plurality of detection data includes the vehicle signal, result information indicating a diagnostic result of the self-diagnostic process performed by the diagnostic unit, and time information indicating the elapsed time measured by the diagnostic unit, and one of the plurality of detection data includes the result information indicating the occurrence of the abnormality as the diagnostic result is referred to as an abnormality detection data, and wherein the in-vehicle control apparatus includes:

a processing unit acquiring the plurality of detection data output from the output unit of the different in-vehicle apparatus and performing the control process based on the vehicle signal included in each of the plurality of detection data;

a first storage capable of storing a data during a powered state of the in-vehicle control apparatus; and a second storage capable of storing a data during both the powered state of the in-vehicle control apparatus and a non-powered state of the in-vehicle control apparatus, wherein the processing unit includes:

a storing section storing a plurality of preliminary analysis data in the first storage in time series, each of the plurality of preliminary analysis data at least including the vehicle signal included in corresponding one of the plurality of detection data; and a backup section reading out, from the first storage, one of the plurality of preliminary analysis data as a reference data upon a confirmation of the abnormality detection data, the one of the plurality of preliminary analysis data being stored in the first storage at a time point prior to a confirmation time point of the abnormality detection data by the elapsed time indicated by the time information of the abnormality detection data, the backup section storing the reference data in the second storage as an analysis data.

2. The in-vehicle control system according to claim 1, wherein, in addition to the reference data, the backup section reads out, from the first storage, one or more of the plurality of preliminary analysis data stored before and after the reference data within a predetermined time period, and wherein the backup section stores the one or more of the plurality of preliminary analysis data read out from the first storage in the second storage as the analysis data together with the reference data.

3. The in-vehicle control system according to claim 1, wherein the diagnostic unit starts to measure the elapsed time upon the appearance of the abnormal symptom in the vehicle signal, wherein the diagnostic unit determines the occurrence of the abnormality when the abnormal symptom appeared in the vehicle signal fails to return to a normal state until the elapsed time reaches a predetermined period, and a time point at which the diagnostic unit determines the occurrence of the abnormality is referred to as a determination time point, and wherein, when the diagnostic unit determines the occurrence of the abnormality at the determination time point, the output unit outputs the detection data including the vehicle signal acquired at the determination time point, the result information indicating the occurrence of the abnormality as the diagnostic result, and the time information indicating the elapsed time measured upon the appearance of the abnormal symptom in the vehicle signal.

4. The in-vehicle control system according to claim 1, wherein the backup section reads out, from the first storage, another one of the plurality of preliminary analysis data as the reference data upon the confirmation of the abnormality detection data, the another one of the plurality of preliminary analysis data being stored in the first storage at a time point prior to the confirmation time point of the abnormality detection data by a cumulative period, wherein the cumulative period is equal to a sum of the elapsed time indicated by the time information of the abnormality detection data and a communication time required for a communication between the in-vehicle control apparatus and the different in-vehicle apparatus, and wherein the backup section stores the reference data read out from the first storage in the second storage as the analysis data.

5. The in-vehicle control system according to claim 1, wherein the output unit outputs the plurality of detection data at predetermined time intervals, and each of the plurality of detection data includes the time information indicating a sum of the elapsed time measured by the diagnostic unit and a communication time required for a communication between the in-vehicle control apparatus and the different in-vehicle apparatus.

6. An in-vehicle control system comprising:

an in-vehicle control apparatus; and a different in-vehicle apparatus communicably connected with the in-vehicle control apparatus, wherein the different in-vehicle apparatus includes:

an output unit outputting, to the in-vehicle control apparatus, a vehicle signal to be utilized in a control process performed by the in-vehicle control apparatus; and a diagnostic unit determining whether an abnormal symptom appears in the vehicle signal and performing a self-diagnostic process based on the vehicle signal to determine an occurrence of an abnormality to a vehicle, wherein the output unit outputs a plurality of detection data at predetermined time intervals, each of the plurality of detection data includes the vehicle signal, result information indicating a diagnostic result of the self-diagnostic process performed by the diagnostic unit, and symptom information indicating whether the abnormal symptom appears in the vehicle signal, and one of the plurality of detection data includes the result information indicating the occurrence of the abnormality as the diagnostic result is referred to as an abnormality detection data, and wherein the in-vehicle control apparatus includes:

a processing unit acquiring the plurality of detection data output from the output unit of the different in-vehicle apparatus and performing the control process based on the vehicle signal included in each of the plurality of detection data;

a first storage capable of storing a data during a powered state of the in-vehicle control apparatus; and a second storage capable of storing a data during both the powered state of the in-vehicle control apparatus and a non-powered state of the in-vehicle control apparatus, wherein the processing unit includes:

a storing section storing a plurality of preliminary analysis data in the first storage, each of the plurality of preliminary analysis data at least including the vehicle signal and the symptom information included in corresponding one of the plurality of detection data, the vehicle signal and the symptom information being stored in the first storage associated with each other; and a backup section reading out, from the first storage, one of the plurality of preliminary analysis data as a reference data upon a confirmation of the abnormality detection data, the one of the plurality of preliminary analysis data including the symptom information indicating the appearance of the abnormal symptom in the vehicle signal, the backup section storing the reference data in the second storage as an analysis data.

7. The in-vehicle control system according to claim 6, wherein the storing unit stores the plurality of preliminary analysis data in the first storage in time series, wherein, in addition to the reference data, the backup section reads out, from the first storage, one or more of the plurality of preliminary analysis data stored before and after the reference data within a predetermined time period, and wherein the backup section stores the one or more of the plurality of preliminary analysis data read out from the first storage in the second storage as the analysis data together with the reference data.

8. An in-vehicle control apparatus communicably connected with a different in-vehicle apparatus that performs a self-diagnostic process, comprising:

a processing unit acquiring, from the different in-vehicle apparatus, a plurality of detection data at predetermined time intervals, each of the plurality of detection data including a vehicle signal to be utilized in a control process, result information indicating a diagnostic result of the self-diagnostic process performed by the different in-vehicle apparatus, and time information indicating an elapsed time measured by the different in-vehicle apparatus upon an appearance of an abnormal symptom in the vehicle signal, the processing unit performing the control process based on the vehicle signal included in each of the plurality of detection data, and one of the plurality of detection data including the result information indicating an occurrence of an abnormality to a vehicle as the diagnostic result being referred to as an abnormality detection data;

a first storage capable of storing a data during a powered state of the in-vehicle control apparatus; and a second storage capable of storing a data during both the powered state of the in-vehicle control apparatus and a non-powered state of the in-vehicle control apparatus, wherein the processing unit includes:

a storing section storing a plurality of preliminary analysis data in the first storage in time series, each of the plurality of preliminary analysis data at least including the vehicle signal included in corresponding one of the plurality of detection data; and a backup section reading out, from the first storage, one of the plurality of preliminary analysis data as a reference data upon a confirmation of the abnormality detection data, the one of the plurality of preliminary analysis data being stored in the first storage at a time point prior to a confirmation time point of the abnormality detection data by the elapsed time indicated by the time information of the abnormality detection data, the backup section storing the reference data in the second storage as an analysis data.

9. The in-vehicle control apparatus according to claim 8, wherein, in addition to the reference data, the backup section reads out, from the first storage, one or more of the plurality of preliminary analysis data stored before and after the reference data within a predetermined time period, and wherein the backup section stores the one or more of the plurality of preliminary analysis data read out from the first storage in the second storage as the analysis data together with the reference data.

10. The in-vehicle control apparatus according to claim 8, wherein the backup section reads out, from the first storage, another one of the plurality of preliminary analysis data as the reference data upon the confirmation of the abnormality detection data, the another one of the plurality of preliminary analysis data being stored in the first storage at a time point prior to the confirmation time point of the abnormality detection data by a cumulative period, wherein the cumulative period is equal to a sum of the elapsed time indicated by the time information of the abnormality detection data and a communication time required for a communication between the in-vehicle control apparatus and the different in-vehicle apparatus, and wherein the backup section stores the reference data read out from the first storage in the second storage as the analysis data.

11. An in-vehicle control apparatus communicably connected with a different in-vehicle apparatus that performs a diagnostic process, comprising:

a processing unit acquiring, from the different in-vehicle apparatus, a plurality of detection data at predetermined time intervals, each of the plurality of detection data including a vehicle signal to be utilized in a control process, result information indicating a diagnostic result of the self-diagnostic process performed by the different in-vehicle apparatus, and symptom information indicating whether an abnormal symptom appears in the vehicle signal, the processing unit performing the control process based on the vehicle signal included in each of the plurality of detection data, and one of the plurality of detection data including the result information indicating an occurrence of an abnormality to a vehicle as the diagnostic result being referred to as an abnormality detection data;

a first storage capable of storing a data during a powered state of the in-vehicle control apparatus; and a second storage capable of storing a data during both the powered state of the in-vehicle control apparatus and a non-powered state of the in-vehicle control apparatus, wherein the processing unit includes:

a storing section storing a plurality of preliminary analysis data in the first storage, each of the plurality of preliminary analysis data at least including the vehicle signal and the symptom information included in corresponding one of the plurality of detection data, and the vehicle signal and the symptom information being stored in the first storage associated with each other; and a backup section reading out, from the first storage, one of the plurality of preliminary analysis data as a reference data upon a confirmation of the abnormality detection data, the one of the plurality of preliminary analysis data including the symptom information indicating the appearance of the abnormal symptom in the vehicle signal, the backup section storing the reference data in the second storage as an analysis data.

12. The in-vehicle control apparatus according to claim 11, wherein the storing unit stores the plurality of preliminary analysis data in the first storage in time series, wherein, in addition to the reference data, the backup section reads out, from the first storage, one or more of the plurality of preliminary analysis data stored before and after the reference data within a predetermined time period, and wherein the backup section stores the one or more of the plurality of preliminary analysis data read out from the first storage in the second storage as the analysis data together with the reference data.

* * * * *